United States Patent [19]

Bucher et al.

[11] Patent Number: 4,546,801

[45] Date of Patent: Oct. 15, 1985

[54] WARP LET-OFF CONTROL DEVICE FOR WEAVING MACHINES

[75] Inventors: Robert Bucher, Frick; Walter Küng, Tann-Dürnten, both of Switzerland

[73] Assignee: Maschinenfabrik Sulzer-Rüti AG, Rüti, Switzerland

[21] Appl. No.: 650,858

[22] Filed: Sep. 14, 1984

[30] Foreign Application Priority Data

Oct. 3, 1983 [EP] European Pat. Off. ..... 83810441.2

[51] Int. Cl.[4] ..... D03D 49/06

[52] U.S. Cl. ..... 139/110

[58] Field of Search ..... 139/101, 110, 109, 103

[56] References Cited

U.S. PATENT DOCUMENTS 2,440,958 5/1948 Kronoff ..... 139/110
4,293,006 10/1981 Peter ..... 139/110

FOREIGN PATENT DOCUMENTS 1138715 10/1962 Fed. Rep. of Germany .
2758816 12/1977 Fed. Rep. of Germany ..... 139/110
613525 8/1926 France ..... 139/110
629549 4/1982 Switzerland .
631756 8/1982 Switzerland .

*Primary Examiner*—Henry S. Jaudon
*Assistant Examiner*—Steven Shongut
*Attorney, Agent, or Firm*—Werner W. Kleeman

[57] ABSTRACT

The control device contains a deflection roll extending over the entire weaving width of the weaving machine, a tensioning beam pivotable about a support beam and also extending over the entire weaving width as well as a sensing roller arranged therebetween and subject to the action of a spring for sensing a portion of the warp threads of the warp, respectively of each partial warp beam. The tensioning beam is subject to the action of a preloaded torsion-bar spring. In this manner a sensing force arises at the sensing roller which can be increased from a first value to a second value according to the position of the tensioning beam. This permits the realization of increased responsiveness of the control device.

5 Claims, 2 Drawing Figures

WARP LET-OFF CONTROL DEVICE FOR WEAVING MACHINES

BACKGROUND OF THE INVENTION

The present invention broadly relates to weaving machines and, more specifically, pertains to a new and improved construction of a warp let-off control device for weaving machines, especially for weaving machines with two or more partial or segmental warp beams.

Generally speaking, the warp let-off control device of the present invention comprises a warp beam, a stationary bar-shaped deflection element for the warp arranged subsequent to the warp beam in the direction of motion of the warp or warp threads as well as a tensioning beam movable by spring action and arranged subsequent to the deflection element in the direction of motion of the warp.

In a previously known control device of this type (cf. Swiss Pat. No. 629,549, granted Apr. 30, 1982) the warp let-off speed is controlled in that the tension, respectively the position, of the warp is sensed by the movable tensioning beam itself. According to the position of the tensioning beam, a signal is transmitted to the control device through an associated sensor. The control device transmits an appropriate signal to the warp beam drive means, whereby the warp let-off speed is adjusted. The reaction speed of this known warp let-off control device is limited in that the entire tensioning beam must follow warp tension changes, for which a certain time interval is required; consequently the warp let-off speed can only be adjusted after this time interval has passed.

SUMMARY OF THE INVENTION

Therefore, with the foregoing in mind, it is a primary object of the present invention to provide a new and improved construction of a warp let-off control device which does not exhibit the aforementioned drawbacks and shortcomings of the prior art constructions.

Another and more specific object of the present invention aims at providing a new and improved construction of a warp let-off control device of the previously mentioned type which more rapidly adjusts the warp let-off speed of the weaving machine.

Yet a further significant object of the present invention aims at providing a new and improved construction of a warp let-off control device of the character described which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the warp let-off control device of the present invention is manifested by the features that a sensing element of the control device is arranged at the warp or warp threads between the deflection element and the tensioning beam and which senses the tension, respectively the momentary path of travel of the warp threads leading over the deflection element and the tensioning beam, and the warp let-off speed is appropriately adjusted.

This permits displacing the working or operating region of the tensioning beam by appropriately preloading its return spring, for instance constituted by a torsion-bar spring, into such a position that a relatively large included angle of the warp threads arises at the sensing element. In this manner, a particularly large resultant sensing force can be produced by the warp tension components. This sensing force acts upon the sensing element and results in particularly rapid reaction to changes in the warp tension and therefore in an immediate adjustment of the warp let-off speed.

In one exemplary embodiment of the invention the warp beam comprises several partial or segmental warp beams. A separate sensing element together with an associated partial control device is associated with each such partial or segmental warp beam. The deflection element and the tensioning beam are each made in one piece and extend over the entire weaving width of the weaving machine. This permits achieving the situation in which the warp tension on one of the partial warp beams is reduced when the warp tension is increased on the other partial warp beam, since the increase of tension on the other partial warp beam pivots the continuous tensioning beam. As a result, the warp tension at the aforementioned one partial warp beam is reduced in consequence of geometry. The warp let-off speed associated with this aforementioned one partial warp beam is immediately reduced by this reduction in warp tension via the associated sensing element.

It is of particular significance that this mutually opposing modification of the warp let-off speeds of the two partial warp beams proceeds independently of whether the two partial warp beams have the same width or different widths. Due to the rapid responsiveness of the control device according to the invention, the adjustment of the warp let-off speeds on both sides of the weaving machine takes place in particularly short time.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
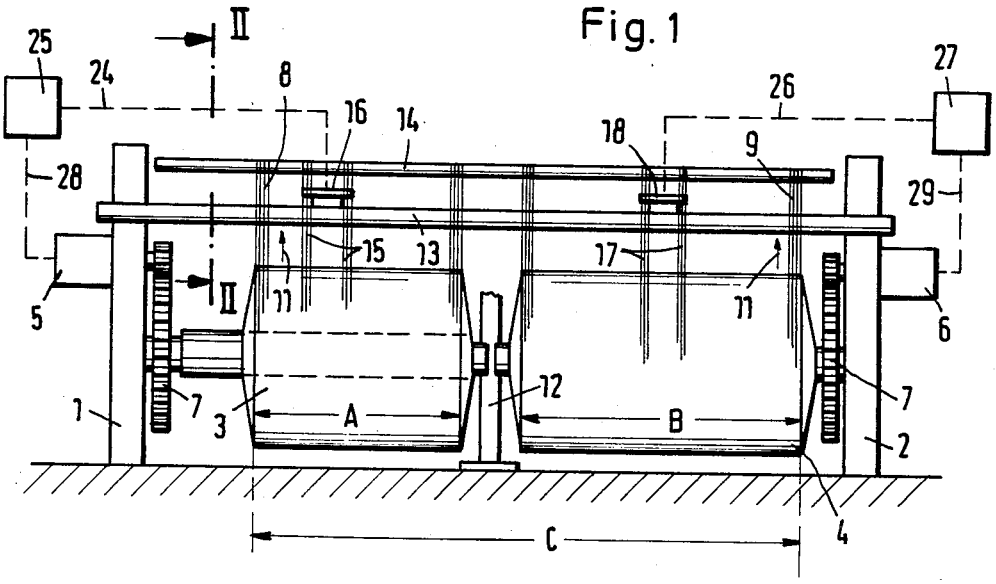
FIG. 1 is a schematic representation of a weaving machine constructed according to the invention and seen from the warp side.

Describing now the drawings, it is to be understood that to simplify the showing thereof only enough of the structure of the warp let-off control device has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise two machine end frames or cheek plates 1 and 2, between which a warp beam for instance as here shown by way of example constituted by two partial or segmental warp beams or warp supply rolls 3 and 4 are arranged. The partial warp beams 3 and 4 have the partial weaving widths A and B, respectively. The partial warp beam 3 is driven by an electric drive motor 5 and the partial warp beam 4 by an electric drive motor 6 via respective gear transmissions or gearing 7. The weaving warp or warp threads 8 run off the partial warp beam 3 and the weaving warp or warp threads 9 run off the partial warp beam 4 in the direction of the arrows 11 and 11*a*, wherein the arrow 11*a* designates the warp direction of motion when the warp at the associated partial warp beam is about to be depleted. The reference numeral 8*a* designates the position of the warp or warp threads when the associated partial warp beam or warp supply roll is empty. The entire weaving width of the machine is designated with the reference character C. The two partial warp beams 3 and 4 are supported in the interior of the weaving machine by an intermediate column or post 12.

The weaving warps 8 and 9 are conducted over a non-rotatable guide or deflection roll or element 13 stationarily mounted in the weaving machine frame subsequent to the warp beam or partial warp beams 3 and 4 in the direction of warp motion 11 and are further conducted over a tensioning beam or roll 14 arranged subsequent to the deflection roll or element 13, whence they are conducted through the further components of the weaving machine such as harnesses, reeds and so forth. The components 13 and 14 extend over the entire width C of the weaving machine.

A number of warp threads 15, for instance 100 warp threads, of the warp 8 is guided over a sensing or feeler roll 16. Analogously, a number of warp threads 17 of the warp 9 is guided over a sensing roll 18. Each sensing roll or element 16 and 18 is fastened upon a leaf spring 20 or equivalent member which is mounted in a mounting shoe 21 at the location 19. The mounting shoe 21 is fastened to the deflection roll 13 by threaded fastening means 22, such as threaded bolts. The mounting shoe 21 also carries a sensor 23. This sensor or sensing element 23 is connected by means of an electrical conductor 24 with a partial control device 25 associated with the partial warp beam 3. The other sensing roller 18 is fastened upon the deflection roll 13 in entirely analogous manner and a control line or conductor 26 leads to a partial control device 27 associated with the partial warp beam 4. The electrical drive motors 5 and 6 of the two partial warp beams 3 and 4 are controlled by the partial control devices 25 and 27 via conductors or lines 28 and 29, respectively.

Figure 2:
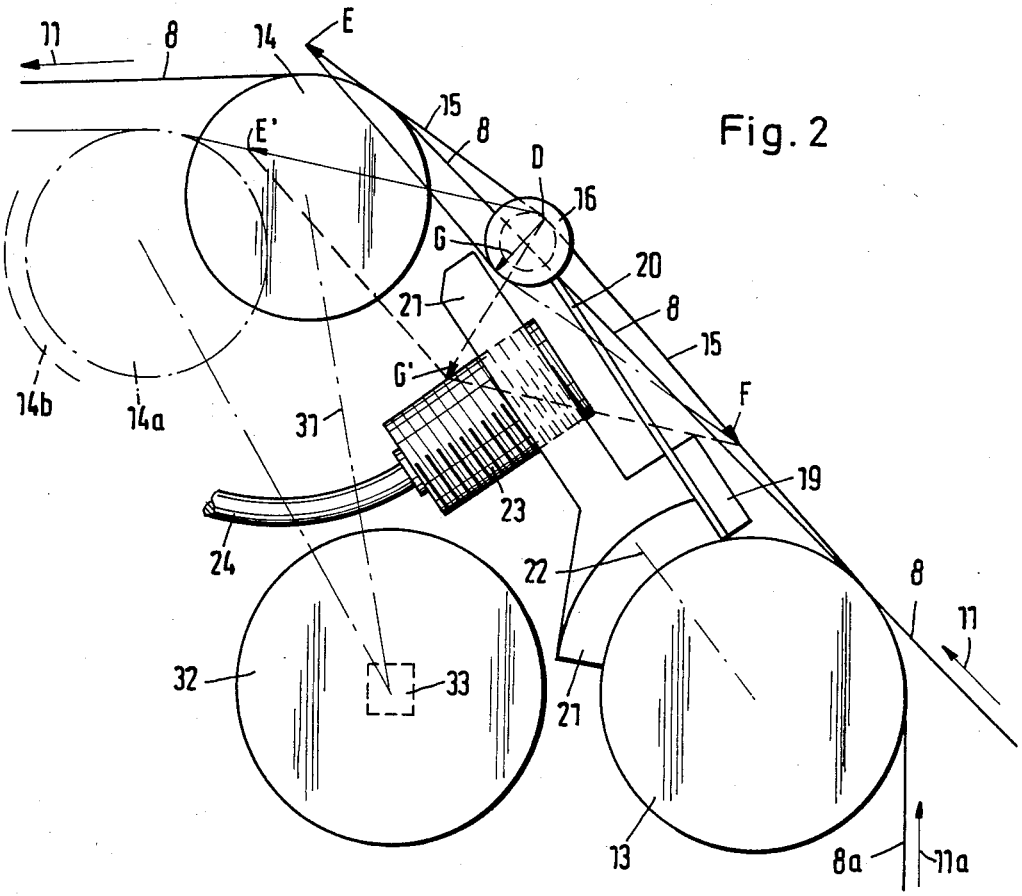
FIG. 2 is a section taken along line II—II in FIG. 1 on an enlarged scale.

The tensioning beam 14 is seated on a pivot lever 31 only schematically indicated in FIG. 2. The pivot lever 31 is connected at one of its ends with a torsion-bar spring 33 arranged in a stationary support beam or support beam tube 32. The torsion-bar spring 33 is connected at its other end with the side or check plates 1 and 2 of the weaving machine frame, for instance as disclosed in Swiss Pat. No. 631,756, granted Aug. 31, 1982. The tension of the warps 8 and 9 is accommodated by the torsion-bar spring 33 which is torqued at one of its ends.

The manner of operation of the described let-off control is as follows. The tensioning beam 14 can, for instance by appropriate preloading of the torsion-bar spring 33, be adjusted such that it assumes the position shown in full lines in FIG. 2. The warp threads 15 of the warp 8 of the partial warp beam 3 run directly from the deflection roll 13 to the tensioning beam 14. The warp threads 15, however, run at a certain angle over the sensing roller 16. The force parallelogram at the point of contact D of the warp threads 15 and the sensing roller 16 is drawn in full lines in FIG. 2. The two equally great warp tension forces are designated with the reference characters E and F. They give rise to the resultant sensing force G directed toward the sensor 23. Its amount can, for instance, be about 20% of the amount of the tension vectors E and F. The force G moves the sensing roller 16 counter to the action of the spring 20 downward to the left in FIG. 2, causing the spring 20 to approach the sensor 23 which may be constituted by a standard proximity sensor. This causes a signal to be transmitted to the related partial control device 25. The partial control device 25 adjusts an appropriate warp let-off speed of the related partial warp beam 3.

If the responsiveness of the control device at a sensing force G of about 20% of the warp tension is not sufficient, the tensioning beam 14 can be, for instance by means of appropriately greater preloading of the torsion-bar spring 33, urged into a working or operating region corresponding to the position 14*a* represented in chain-dotted lines in FIG. 2. The warp tension arising at the location D and directed toward the tensioning beam located at the position 14*a* now corresponds to the vector E'. There therefore arises a considerably greater sensing force corresponding to the vector G' of about 60% of the warp tension E'. This considerably increases the responsiveness of the control device and therefore the rapidity of adjustment of the momentary warp let-off speed.

The force relationships at the other sensing roller 18 correspond to those at the sensing roller 16 as is shown in FIG. 2.

When, for instance, the tension in the warp 8 increases and the tensioning beam 14 is temporarily pivoted out of the position 14*a* shown in chain-dotted lines in FIG. 2 into a position 14*b* shown in broken lines, then the warp let-off speed at the partial warp beam 3 is immediately increased through the associated sensor 23 and partial control device 25. Since the tensioning beam 14 is in the position 14*b*, the tension in the warp 9 is reduced in consequence of geometrical reasons. A correspondingly opposite signal is then transmitted to the partial control device 27 by the sensing roller 18, causing the warp let-off speed at the related partial warp beam 4 to be immediately reduced. The desired equal warp tensions in the two warps 8 and 9 are therefore reestablished in very short time.

As previously indicated, the warp let-off control device can also be employed with a continuous single warp beam having a length or width corresponding to the entire weaving width C. In this case, a single sensing roller 16 or 18 suffices. On the other hand, the control device can also be employed in weaving machines with, for instance, three partial warp beams. Then three sensing rollers are necessary, one for each partial warp beam. The tensioning beam 14 can also be subject to the action of two laterally arranged spiral or coil springs, for instance corresponding to the arrangement shown in German Pat. No. 1,138,715, granted May 16, 1963.

While there are shown and described present preferred embodiments of the invention, it is to be distinctly understood that the invention is not limited thereto, but may be otherwise variously embodied and practiced within the scope of the following claims. Accordingly,

What we claim is:

1. A warp let-off control device for a weaving machine, comprising:

warp beam means for delivering a warp containing warp threads at a predeterminable let-off speed;

a stationary deflection element cooperating with the warp and arranged subsequent to said stationary warp beam with respect to a predetermined direction of motion of the warp;

a tensioning beam movable by spring action and arranged subsequent to said deflection element with respect to said direction of motion of the warp;

a sensing element arranged at the warp at a location between said stationary deflection element and said tensioning beam for sensing tension of at least predetermined ones of said warp threads of the warp;

means for adjusting the predeterminable let-off speed of the warp from the warp beam means in response to the thread tension sensed by the sensing element;

said warp beam means comprising a plurality of partial warp beams;

said sensing element comprising separate sensing elements with each said separate sensing element being operatively associated with a respective partial warp beam of said plurality of partial warp beams;

a partial control device operatively associated with each said separate sensing element;

said stationary deflection element being made in one piece and extending over a full weaving width of the weaving machine;

said tensioning beam being made in one piece and extending over the full weaving width of the weaving machine;

each of said sensing elements comprising a sensing roller subject to spring action;

each of said plurality of partial warp beams having a respective predetermined width;

each of said sensing rollers being operatively associated with a predetermined one of said plurality of partial warp beams; and each of said sensing rollers at most extending over said respective predetermined width of each associated one of said partial warp beams.

2. The warp let-off control device as defined in claim 1, further including:

a plurality of stationary sensors;

each of said plurality of stationary sensors being arranged opposite an associated one of said plurality of sensing rollers; and each of said plurality of sensing rollers cooperating with the associated one of said plurality of stationary sensors.

3. The warp let-off control device as defined in claim 1, further including:

a plurality of drive motors;

each one of said plurality of drive motors being controlled by an associated one of said at least two partial control devices; and each one of said plurality of drive motors driving an associated one of said plurality of partial warp beams.

4. The warp let-off control device as defined in claim 1, wherein:

each said sensing roller detects the thread tension in response to the influence of the direction of motion of the warp.

5. The warp let-off control device as defined in claim 1, wherein:

said stationary deflection element is substantially bar-shaped.

* * * * *